US010584453B2

(12) United States Patent
Zhao et al.

(10) Patent No.: US 10,584,453 B2
(45) Date of Patent: Mar. 10, 2020

(54) METHOD FOR FABRICATING WIRE STRAND FOR MAIN CABLE OF SUSPENSION BRIDGE

(71) Applicant: JIANGSU FASTEN STEEL CABLE CO., LTD., Jiangyin (CN)

(72) Inventors: Jun Zhao, Jiangyin (CN); Shiwei Ning, Jiangyin (CN); Huajuan Xue, Jiangyin (CN); Zhubing Zhou, Jiangyin (CN); Qiong Wu, Jiangyin (CN); Qiang Qiang, Jiangyin (CN); Kebin Huang, Jiangyin (CN); Xiaoxiong Zhu, Jiangyin (CN); Weihong Shu, Jiangyin (CN); Jin Wang, Jiangyin (CN); Zhongmei Liang, Jiangyin (CN); Pengcheng Zhai, Jiangyin (CN)

(73) Assignee: JIANGSU FASTEN STEEL CABLE CO., LTD., Jiangyin (CN)

( * ) Notice: Subject to any disclaimer, the term of this patent is extended or adjusted under 35 U.S.C. 154(b) by 85 days.

(21) Appl. No.: 15/839,805

(22) Filed: Dec. 12, 2017

(65) Prior Publication Data

US 2018/0100278 A1 Apr. 12, 2018

Related U.S. Application Data

(63) Continuation-in-part of application No. PCT/CN2016/073350, filed on Feb. 3, 2016.

(30) Foreign Application Priority Data

Dec. 10, 2015 (CN) ..... 2015 1 0906592

(51) Int. Cl.

| | |
|---|---|
| ***E01D 19/16*** | (2006.01) |
| ***E01D 11/02*** | (2006.01) |
| ***D07B 1/06*** | (2006.01) |
| ***E01D 19/14*** | (2006.01) |

(52) U.S. Cl.

CPC ..... *E01D 19/16* (2013.01); *D07B 1/0693* (2013.01); *E01D 11/02* (2013.01); *E01D 19/14* (2013.01);

(Continued)

(58) Field of Classification Search

CPC ..... Y10T 29/49988; Y10T 29/5121; Y10T 29/4989; Y10T 29/49826; Y10T 29/49801;

(Continued)

(56) References Cited

U.S. PATENT DOCUMENTS 3,500,625 A * 3/1970 Gokyu ..... D07B 1/10 14/22
3,526,570 A * 9/1970 Beighley ..... B65H 51/14 14/23

(Continued)

*Primary Examiner* — Sarang Afzali
*Assistant Examiner* — Darrell C Ford
(74) *Attorney, Agent, or Firm* — Yue (Robert) Xu; Apex Attorneys at Law, LLP

(57) ABSTRACT

A method for fabricating a wire strand from parallel steel wires for a main cable of a suspension bridge, the method including: 1) selecting and coloring a steel wire as a marking steel wire which is to be positioned at a vertex of a wire strand including a plurality of parallel steel wires and having an equilateral polygon section; 2) drawing position markers at positions of the standard steel wire corresponding to control points of splay cable saddles, center points of main cable saddles, middle points of side spans, a middle point of a middle span, and starting points of anchor heads of anchor spans of a suspension bridge; 3) relaxing and shaping coils of the steel wires to yield a prefabricated wire strand; 4) preforming the positions of the cable saddles; 5) coiling the wire strand including; and 6) casting anchor of the wire strand.

9 Claims, 8 Drawing Sheets

(52) U.S. Cl.
CPC ..... *D07B 2201/2044* (2013.01); *D07B 2501/203* (2013.01)

(58) Field of Classification Search
CPC ..... E01D 19/16; E01D 19/14; E01D 11/02; D07B 5/002; D07B 1/148; D07B 1/0693; D07B 7/10; D07B 2207/4031; D07B 2205/3071; D07B 2201/2089; D07B 2501/203; D07B 2201/2044
USPC ..... 29/527.5, 34 D, 461, 428, 419.1
See application file for complete search history.

(56) References Cited

U.S. PATENT DOCUMENTS

| | | | | |
|---|---|---|---|---|
| 5,573,852 | A * | 11/1996 | Thal | D07B 1/144 428/373 |
| 6,560,807 | B1 * | 5/2003 | Stubler | D07B 1/068 14/22 |
| 2003/0110583 | A1 * | 6/2003 | Stubler | D07B 1/068 14/22 |
| 2005/0193794 | A1 * | 9/2005 | Rex | B21C 47/04 72/289 |
| 2008/0210330 | A1 * | 9/2008 | Anderson | B65H 49/321 140/147 |
| 2011/0240626 | A1 * | 10/2011 | Mullebrouck | D02G 3/12 219/260 |
| 2012/0084948 | A1 * | 4/2012 | Breen, IV | B65D 63/1063 24/16 R |
| 2012/0260590 | A1 * | 10/2012 | Lambert | E01D 19/16 52/223.13 |

* cited by examiner

METHOD FOR FABRICATING WIRE STRAND FOR MAIN CABLE OF SUSPENSION BRIDGE

CROSS-REFERENCE TO RELATED APPLICATIONS

This application is a continuation-in-part of International Patent Application No. PCT/CN2016/073350 with an international filing date of Feb. 3, 2016, designating the United States, now pending, and further claims foreign priority benefits to Chinese Patent Application No. 201510906592.8 filed Dec. 10, 2015. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, and Cambridge, Mass. 02142.

BACKGROUND OF THE INVENTION

Field of the Invention

The invention belongs to the technical field of suspension bridges, and more particularly to a method for fabricating a wire strand from parallel steel wires for a main cable of a suspension bridge.

Description of the Related Art

Suspension bridge is a type of bridge in which the deck is hung below suspension cables on vertical suspenders. The suspension cables, also the main cables, are made of large diameter high strength zinc-coated steel wires.

Conventionally, the suspension cables are fabricated mainly using air spinning (AS) method. In the method, between 400 and 500 steel wires are formed into one wire strand, and between 30 and 90 wire strands are fabricated into one main cable. As such, one single wire strand requires large anchoring tonnage, and the anchoring space is compact. In addition, the main cable installation is labor-intensive and time-consuming, and the main cable is affected by weather conditions.

SUMMARY OF THE INVENTION

In view of the above-described problems, it is one objective of the invention to provide a method for fabricating a wire strand from parallel steel wires for a main cable of a suspension bridge. The method includes: prefabricating regular hexagon wire strands using a plurality of zinc-coated wires in a plant, each wire strand comprising 61 wires (optionally 91 or 127 wires), anchoring two ends of the wire strand by hot-casting anchors, pre-forming the wire strand in a plant for facilitating insertion of the wire strand into saddles during construction, then coiling the wire strands and transporting the wire strand coils to a construction field, and respectively laying the wire strands.

To achieve the above objective, in accordance with one embodiment of the invention, there is provided a method for fabricating a wire strand from parallel steel wires for a main cable of a suspension bridge, the method comprising the following steps:

1) Fabricating a Marked Steel Wire

In order to conveniently observe and discriminate whether wire strands are twisted during fabrication and laying of the wire strand, a marked steel wire is set at a vertex of the hexagonal cross section of each wire strand and the marker wire is coated with a color for discrimination. Generally, the steel wire is marked red.

2) Fabricating a Steel Wire with Standard Length

A cable shape is one of important parameters of the suspension bridge, and a length of each wire strand is required to be controlled during fabrication. In order to control length accuracy of a parallel wire unit for the prefabricated wire strand, one, two, or more than two steel wires having standard lengths are set at vertexes of the hexagonal cross section as standard wires functioning in controlling a whole length of the wire strand of the main cable of the suspension bridge. Preferably, one or multiple standard wires are set at vertexes of the hexagonal cross sections to realize the double control of the wire strand's length and to measure a within-wire strand error using a length difference between two standard wires.

In the meanwhile, obvious position markers are made according to design requirements at feature locations on each standard wire corresponding to control points of splay cable saddles, center points of main cable saddles, middle points of side spans, a middle point of a middle span, and starting points being one meter away from anchor heads of anchor spans, and the position makers are made as follows:

A length of each steel wire free from stress is used as a standard, and an operation correction is calculated in view of error factors. Thereafter, the steel wire is loaded and stretched on a base line in the construction field. A temperature is measured, and errors resulting from the temperature, a stress, and a sag, and other factors are corrected. During the fabrication, a displacement is repeatedly checked and marked to make specific marking positions.

The length of the standard wire is determined by baseline measurement. Specifically, a tensioning force is applied to two ends of the steel wires to make the steel wires straight, and stress correction and temperature correction are then carried out according to the following equation:

$$L=L_0\times[(1+F/EA)+\alpha(T-20)]$$

in which, L represents a length (m) of a steel wire under a stress, $L_0$ represents a designed length (m) of a steel wire free from a stress, F represents a tensioning force (N), E represents an elastic module (MPa) of a steel wire, and fabrication of the standard wire adopts a measured value, A represents an area of a cross section ($m^2$) of the steel wire, and fabrication of the standard wire adopts the measured value, $\alpha$ represents an expansion coefficient of the steel wire, and T represents a temperature of the environment.

The systematic error in the fabrication process of the standard wire of the wire strand is greatly reduced by the above method. The fabrication precision of the standard wire exceeds $1/30000$, the fabrication precision of the finished wire strand is increased to $1/20000$ from the industry standard of $1/12000$, the manually marking mistakes are greatly reduced, and the property of the production of the human error is reduced, thus improving the working efficiency.

3) Relaxing Coils of Steel Wires for Shaping

Each prefabricated wire strand is formed by multiple (61, 91, 127, or 169) steel wires. During the preformation, coils of steel wires (including the marked steel wire and the standard steel wire) having the same double length and the same rotation direction are put into a pay-out stand and a tension of each coil of the steel wire is then regulated. A tension of the steel wire relaxing is the main factor affecting the within-wire strand error, and uneven tension easily results in length inconsistency of the steel wires within the wire strand, thus the tension of each coil of the steel wire is required to be basically consistent. In fabrication of the prefabricated wire strand, a rolling mold formed by shaping wheels is utilized to shape a cross section of the parallel steel wires. The rolling mold possesses a hexagonal cross section corresponding to the shape of the cross section of the wire strand. The pre-formed parallel wire unit is set and wrapped at equal intervals by a high strength wrapping bandage to avoid scattering of the steel wires during traction. During the prefabrication in the plant, a surface of the wire strand is wrapped by the wrapping bandage to well fix the shape of the steel wire unit.

As the wrapping bandage generally adopts high polymer materials, the performance thereof is inevitably affected by factors including the temperature and the sunlight and therefore deteriorated. In addition, the construction conditions in the construction field are complicated, no cracking of the wrapping bandage during the laying process of the wire strand is almost impossible. If the cracking of the wrapping bandage occurs at critical positions like the main cable saddles and the splay cable saddles, when the wire strand is accommodated in the saddle, bulges and displacement errors of the steel wires occur, and the shape of the wire strand cannot be adjusted beyond cable saddles. Thus, if the wire strand at the wire strand feature points (features points are set at two sides of the main cable saddles and the splay cable saddles, if the span is too large, a plurality of additional feature points are set within the span) keep good shape and no relative displacement in the longitudinal direction of the steel wires occurs, then after being accommodated in the cable saddle, the wire strand is exerted with the self-gravity, and certain wrapping bandages between two feature positions are cut off from the wire strand and the wire strand is knocked to remove the wire bulges and the displacement errors of the wires and to recover the hexagonal shape of the original wire strand. Based on the above reasons, in addition to the arrangement of the wrapping bandage on the wire strand at certain intervals, steel wire hoops or shaping clips are reasonably arranged on the wire strand. The steel wire hoops are able to locate the whole wire strand of a certain shape into the saddles, prevent the displacement errors of the wires of the wire strand, and ensure the cross section of the critical parts, which are beneficial to the observation and location when laying the wire strand. Even the wrapping bandage of a certain section of the wire strand is seriously cracked which results in wire scattering, it is convenient to repair such local regions under the restrain of the steel wire hoops or the shaping clips. In the meanwhile, the steel wire hoops and the shaping clips also ensure good shapes of the wire strand in the vicinity of the cable saddles and bring great benefit for local repair. Positions for arranging the steel wire hoops or the shaping clips comprise: positions in the vicinity of center points of corresponding splay cable saddles, positions in the vicinity of center points of main cable saddles, middle points of side spans, starting points of anchor heads of the side spans, and the middle point of the main span. The steel wire hoops are formed by wrapping zinc-coated steel wires. Materials of the steel wire hoops and the wire strand belong to the same series. To reduce the injury on the steel wires of the inner wire strand, the steel wire hoops have a length of between 100 and 300 mm and a diameter of between 1.0 and 3.0 mm.

4) Preforming of Positions of the Cable Saddles

Shapes of positions of the wire strand corresponding to the main cable saddles and the splay cable saddles are preformed to make the shape of the cross section of the wire strand to be preformed match with the shapes of inner cavities of the main cable saddles and the splay cable saddles thus facilitating the accommodation of the wire strand in the saddles. Specific operations are as follows: dimensions and cross sections of the wire strand before and after the preforming are firstly designed according to the dimensions of the inner cavities of the main cable saddles and the splay cable saddles. According to the design, the wire strand is processed to have the shape of the target cross section corresponding to the shapes of the inner cavities of the main cable saddles and the splay cable saddles. Positions to be preformed of the wire strand corresponding to the main cable saddles and the splay cable saddles are processed by a shaping machine to shape the cross section of the wire strand into the target shape, and then respectively fixed using retaining clips having a quadrilateral inner cavity for several times. Fixed positions are wrapped by the wrapping bandages for setting the shape.

5) Coiling the Prefabricated Parallel Wire Preforming Wire Strand

The coiling and the cable relaxing are two opposite operations having close relations therebetween but also being in conformity with separate motion rule. Different steel wires have different bend radius, and a bending force of the steel wire relates to the bending radius. The smaller the bending radius is, the greater the bending force is. As long as a coiling force is larger than the bending force, the wire strand is able to coil. Thus, the tightness of the coiling is affected by the coiling force. The tightness of the coiling directly affects the progress of the cable relaxing and also indirectly affects the forming quality of the wire strand. The prefabricated wire strand is coiled by a coil frame, and a coil diameter is equal to or larger than 30 folds of the diameter of the wire strand.

6) Casting Anchor of the Prefabricated Parallel Wire Pre-Forming Wire Strand

The anchor device is the main structure to transmit a cable tension of the prefabricated parallel wire preformed wire strand to an anchor system. Zinc-copper alloy or zinc-copper-aluminum alloy is adopted for casting, and the casting process is as follows:

a. Ends of the wire strand are perpendicularly fixed in a casting platform of an anchor cup, the steel wires of the wire strand inserted into the anchor cup are dispersed in the form of concentric circles, oil stains and rusts are removed from the steel wires of the wire strand, a uniform space is maintained, and an inner wall of the anchor cup is cleaned.

b. After the wire strand is inserted into the anchor cup, a center of the wire strand coincides with a center of the anchor cup, and the steel wire is prevented from contacting with the anchor cup.

c. A vertical length of the wire strand beneath the anchor cup is equal to or larger than 30 folds of the diameter of the wire strand, and a curved radius is required to be 25 folds larger than the diameter of the wire strand.

d. A lower opening of the anchor cup is required to be fully sealed to ensure no leakage of the poured alloy from the lower opening, and the anchor cup is preheated before casting the zinc-copper alloy or zinc-copper-aluminum alloy.

e. When pouring the alloy into the anchor cup, vibration is prevented, and the casting is carried out fluently without disruption.

In a class of this embodiment, the wrapping bandage utilizes a complex of a high strength polyester and fiber bands as a matrix, and a surface of the matrix is coated with a pressure-sensitive adhesive of high viscosity.

In a class of this embodiment, in 4), the cross section of the wire strand to be preformed is shaped from a hexagon into a quadrilateral to make preformed positions of the wire strand matching with inner cavities of the main cable saddles and the splay cable saddles.

In a class of this embodiment, the shaping machine of 4) comprises: a U-shaped base and a cover plate disposed at an opening above the U-shaped base; and the U-shaped base and the cover plate are enclosed to form a quadrilateral through hole matching with the quadrilateral cross section of the wire strand.

In a class of this embodiment, curved ribs are formed on inner sides opposite to the U-shaped base; an extending direction of the curved ribs is parallel to the steel wires of the wire strand; and a radius of each curved rib and an interval between adjacent curved ribs respectively match with a radius of the steel wire of the wire strand.

In a class of this embodiment, the retaining clip of 4) comprises a quadrilateral through hole for allowing the quadrilateral wire strand to pass through; and the retaining clip is formed by locking two independent clamping blocks having square openings together.

In a class of this embodiment, the U-shaped base and the cover plate are both made of nylon materials to avoid the destruction on the steel wire.

Advantages of the method for fabricating a wire strand from parallel steel wires for the main cable of the suspension bridge in accordance with embodiments of the invention are summarized as follows: in the method, regular hexagon wire strands are prefabricated using a plurality of zinc-coated wires in a plant, the wire strand are then preformed at specific positions for facilitating insertion of the wire strand into saddles, two ends of the wire strand are anchored by the hot-casting anchors, and then the wire strands are coiled and transported to the construction field where the wire strand are respectively laid.

BRIEF DESCRIPTION OF THE DRAWINGS

The invention is described hereinbelow with reference to the accompanying drawings, in which.

DETAILED DESCRIPTION OF THE EMBODIMENTS

For further illustrating the invention, experiments detailing a method for fabricating a wire strand from parallel steel wires for a main cable of a suspension bridge are described below. It should be noted that the following examples are intended to describe and not to limit the invention.

A method for fabricating a wire strand from parallel steel wires for a main cable of a suspension bridge is illustrated. The method includes: prefabricating regular hexagon wire strands using a plurality of zinc-coated wires in a plant, each wire strand comprising 61 wires (optionally 91 or 127 wires, according to working conditions), pre-forming quadrilateral cross sections at certain positions of the wire strand corresponding to main cable saddles and splay cable saddles for accommodating the wire strand of certain positions in cable saddles, anchoring two ends of the wire strand by hot-cast anchors, coiling and transporting the wire strands to a construction field, and respectively laying the wire strand.

The method is specifically conducted as follows:

1) Fabricating a Marked Steel Wire

In order to conveniently observe and discriminate whether wire strands are twisted during fabrication and laying of the wire strand, a marked steel wire is set at a left upper corner of the hexagonal cross section of each wire strand and the steel wire is marked red.

2) Fabricating a Wire with Standard Length

Figure 2:
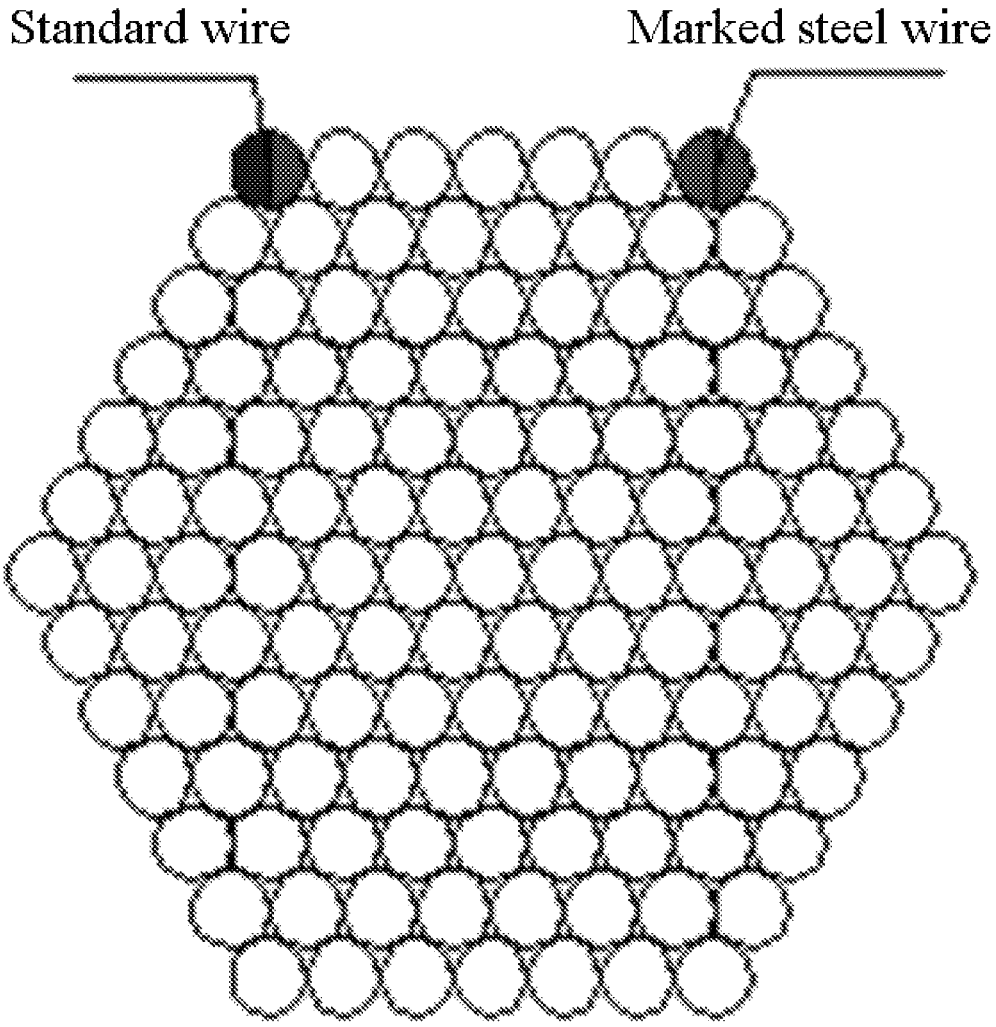
FIG. 2 is a structure diagram showing arrangement of a standard wire and a marked steel wire in a wire strand of a small specification in accordance with one embodiment of the invention.
Figure 3:
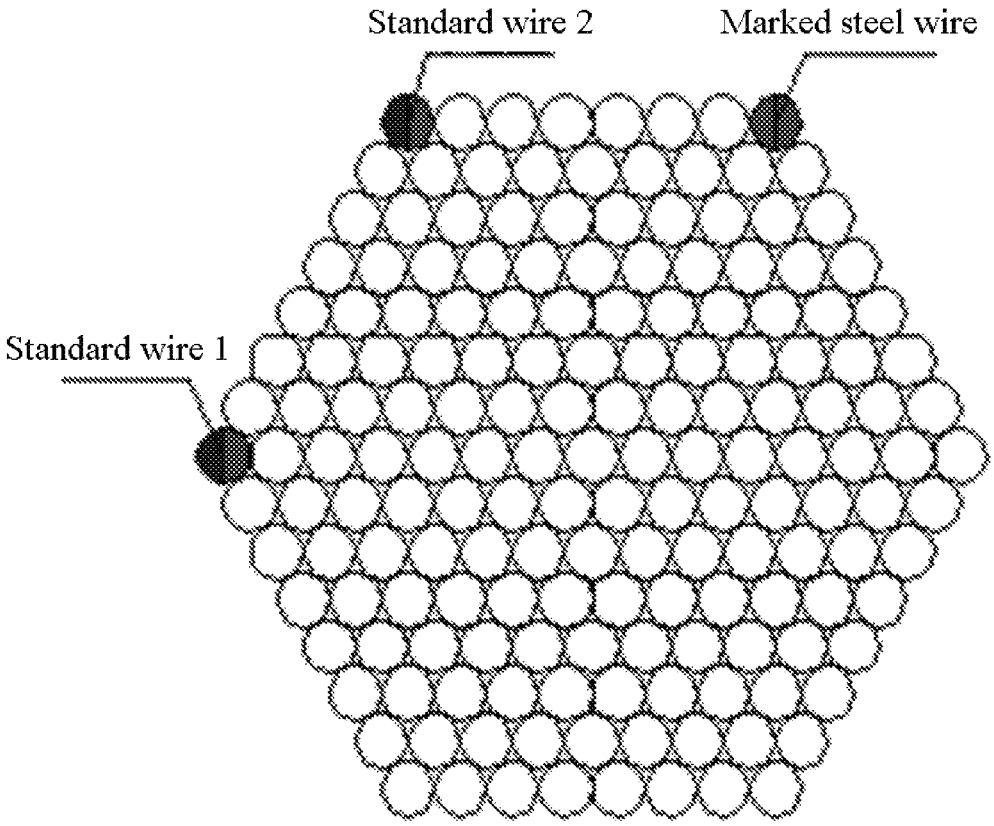
FIG. 3 is a structure diagram showing arrangement of standard wires and a marked steel wire in a wire strand of a large specification in accordance with one embodiment of the invention.

In order to control length accuracy of a parallel wire unit for the prefabricated wire strand, steel wires having standard lengths are set at vertexes of the hexagonal cross section as standard wires functioning in controlling a whole length of the wire strand of the main cable of the suspension bridge. For wire strand of large specification, the standard wires are set at two vertexes of the hexagonal cross sections to realize the double control of the wire strand's length and to measure a within-wire strand error using a length difference between the two standard wires, as shown in FIGS. 2-3.

Figure 1:
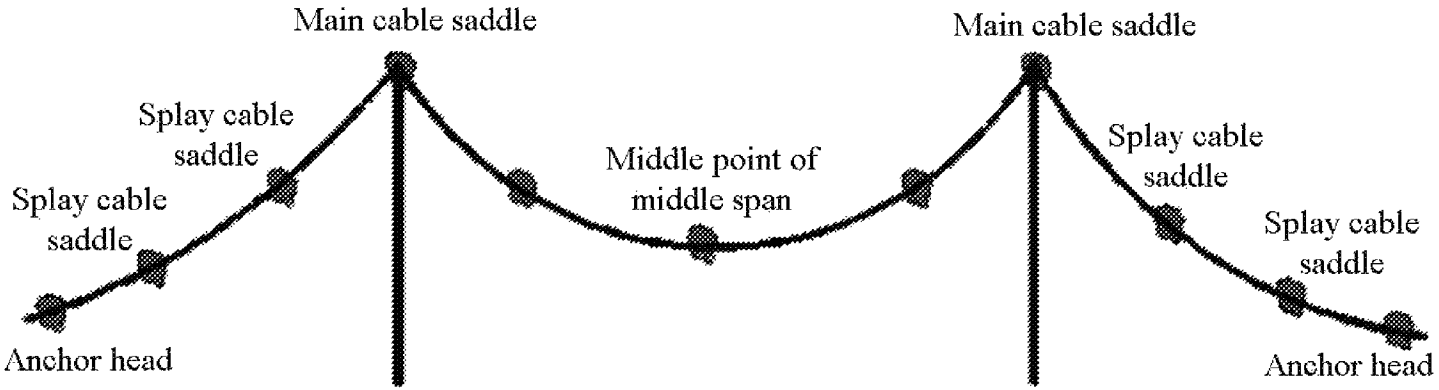
FIG. 1 is a structure diagram showing distribution of feature points of a standard wire in accordance with one embodiment of the invention.

In the meanwhile, as shown in FIG. 1, obvious position markers are made according to design requirements at feature locations on each standard wire corresponding to control points of splay cable saddles, center points of main cable saddles, middle points of side spans, a middle point of a middle span, and starting points being one meter away from anchor heads of anchor spans, and the position makers are made as follows:

A length of each standard wire free from stress is used as a standard, and an operation correction is calculated in view of error factors. Thereafter, the steel wires are loaded and stretched on a base line in the construction field. A temperature is measured, and errors resulting from the temperature, a stress, and a sag, and other factors are corrected. During the fabrication, a displacement is repeatedly checked and marked to make specific marking positions.

The length of the standard wire is determined by baseline measurement. Specifically, a tensioning force is applied to two ends of the steel wires to make the steel wires straight, and stress correction and temperature correction are then carried out according to the following equation:

$$L=L_0\times[(1+F/EA)+\alpha(T-20)]$$

in which, L represents a length (m) of a steel wire under a stress, $L_0$ represents a designed length (m) of a steel wire free from a stress, F represents a tensioning force (N), E represents an elastic module (MPa) of a steel wire, and fabrication of the standard wire adopts a measured value, A represents an area of a cross section ($m^2$) of the steel wire, and fabrication of the standard wire adopts the measured value, α represents an expansion coefficient of the steel wire, and T represents a temperature of the environment.

The systematic error in the fabrication process of the standard wire of the wire strand is greatly reduced by the above method. The fabrication precision of the standard wire exceeds 1/30000, the fabrication precision of the finished wire strand is increased to 1/20000 from the industry standard of 1/12000, the manually marking mistakes are greatly reduced, and the property of the production of the human error is reduced, thus improving the working efficiency.

3) Relaxing Coils of Steel Wires for Shaping

Each prefabricated wire strand is formed by multiple steel wires. During the preformation, coils of steel wires having the same double length and the same rotation direction are put into a pay-out stand and a tension of each coil of the steel wire is then regulated. In fabrication of the prefabricated wire strand, a rolling mold formed by shaping wheels is utilized to shape a cross section of the parallel steel wires. The rolling mold possesses a hexagonal cross section corresponding to the shape of the cross section of the wire strand. The pre-formed parallel wire unit is set and wrapped at equal intervals by a high strength wrapping bandage to avoid scattering of the steel wires during traction. The wrapping bandage utilizes a complex of a high strength polyester and fiber bands as a matrix, and a surface of the matrix is coated with a pressure-sensitive adhesive of high viscosity.

In addition to the arrangement of the wrapping bandage on the wire strand at certain intervals, steel wire hoops are reasonably arranged on the wire strand. The steel wire hoops are able to locate the whole wire strand of a certain shape into the saddles and to avoid wire scattering occurred in the wire strand, thus ensuring the shape of the cross section of critical portions for the observation and location in laying the wire strand. Even the wrapping bandage of a certain section of the wire strand is seriously cracked which results in wire scattering, it is convenient to repair such local regions under the restrain of the steel wire hoops. Positions for arranging the steel wire hoops comprise: positions in the vicinity of center points of corresponding splay cable saddles, positions in the vicinity of center points of main cable saddles, middle points of side spans, starting points of anchor heads of the side spans, and the middle point of the main span. The steel wire hoops are formed by wrapping zinc-coated steel wires. Materials of the steel wire hoops and the wire strand belong to the same series. To reduce the injury on the steel wires of the inner wire strand, the steel wire hoops have a length of between 100 and 300 mm and a diameter of between 1.0 and 3.0 mm.

4) Preforming of Positions of the Cable Saddles

Positions to be preformed of the wire strand corresponding to the main cable saddles and the splay cable saddles are processed by a shaping machine having a quadrilateral inner cavity to shape the cross section of the wire strand from the hexagon into the quadrangle, and then respectively fixed using retaining clips having a quadrilateral inner cavity for four times. Fixed positions are wrapped by the wrapping bandages for setting the shape. The wrapping bandages are wrapped for between 8 and 10 layers, a width of the bandage is between 40 and 60 mm, and a thickness of the bandage is between 0.15 and 0.25 mm, and a tensile resistance of a single layer of the bandage is equal to or larger than 1 kN, thus ensuring that the wire strand of the preformed positions effectively maintains the quadrilateral shape after being coiled. The wrapping by the wrapping bandage has no corrosion on the steel wire and does not destroy the quality of the steel wire.

Figure 4:
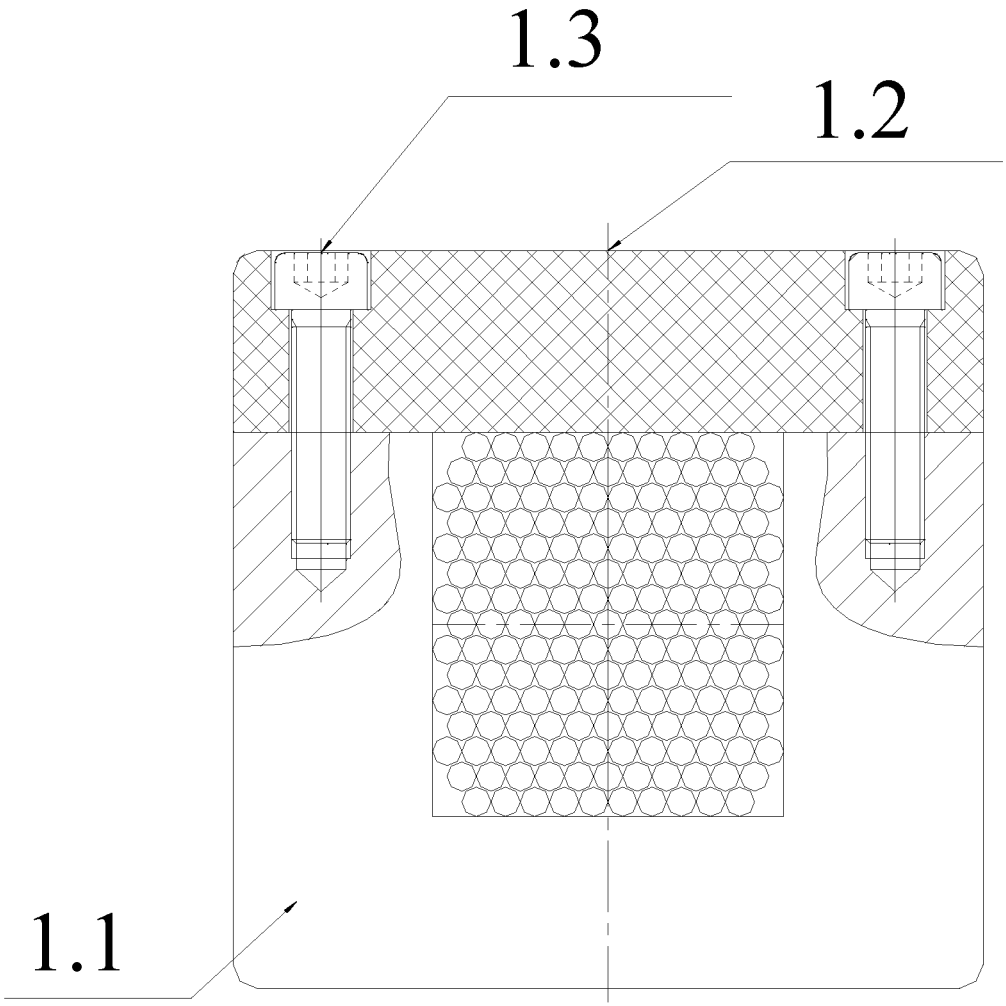
FIG. 4 is a structure diagram of a shaping machine having a quadrilateral inner cavity in shaping a cross section of a wire strand in accordance with one embodiment of the invention.
Figure 5:
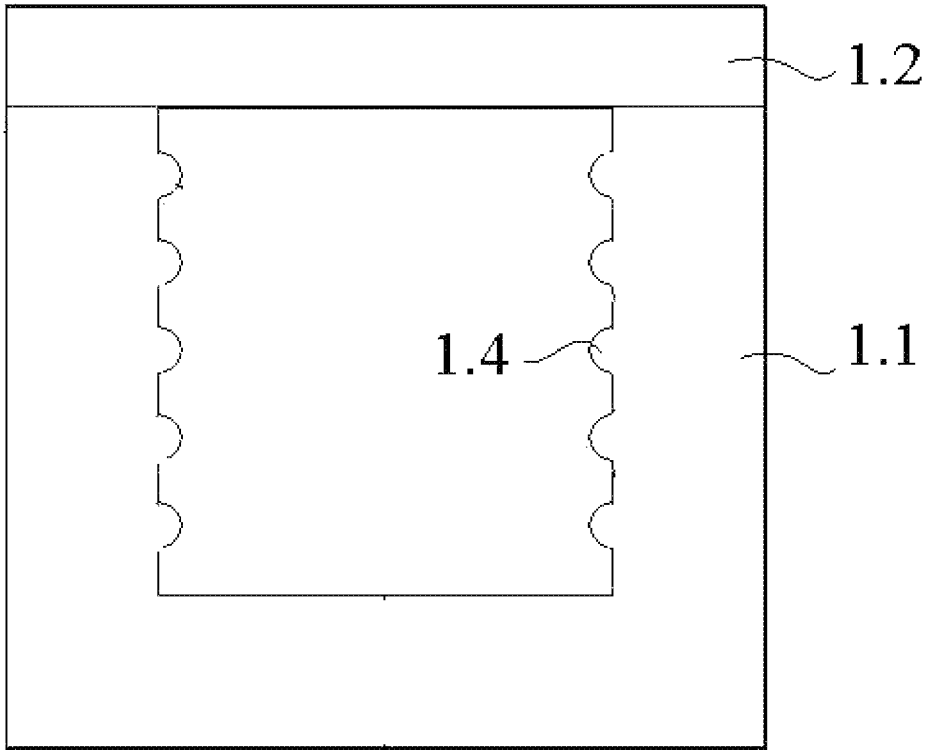
FIG. 5 is a front view of a shaping machine having a quadrilateral inner cavity in accordance with one embodiment of the invention.
Figure 6:
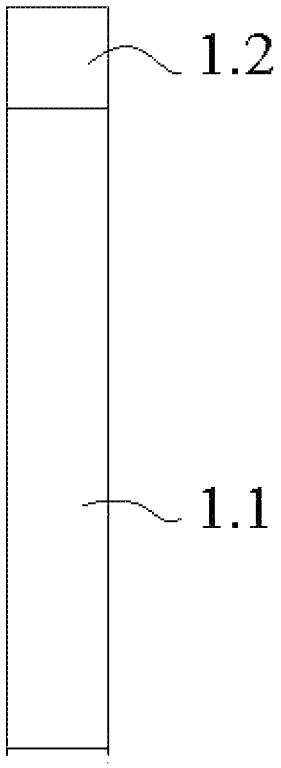
FIG. 6 is a side view of a shaping machine having a quadrilateral inner cavity in accordance with one embodiment of the invention.

As shown in FIGS. 4-6, the shaping machine comprises: a U-shaped base 1.1 and a cover plate 1.2 disposed at an opening above the U-shaped base 1.1. The U-shaped base 1.1 and the cover plate 1.2 are both made of nylon materials to avoid the destruction on the steel wire. The U-shaped base 1.1 and the cover plate 1.2 are enclosed to form a quadrilateral through hole matching with the quadrilateral cross section of the wire strand, and the U-shaped base 1.1 and the cover plate 1.2 are connected and fixed together by hexagonal screws 1.3.

Furthermore, curved ribs 1.4 are formed on inner sides opposite to the U-shaped base 1.1. An extending direction of the curved ribs 1.4 is parallel to the direction of the quadrilateral through hole, and a radius of each curved rib 1.4 and an interval between adjacent curved ribs 1.4 respectively match with a radius of the steel wire of the wire strand, thus facilitating the preforming of the wire strand.

Figure 7:
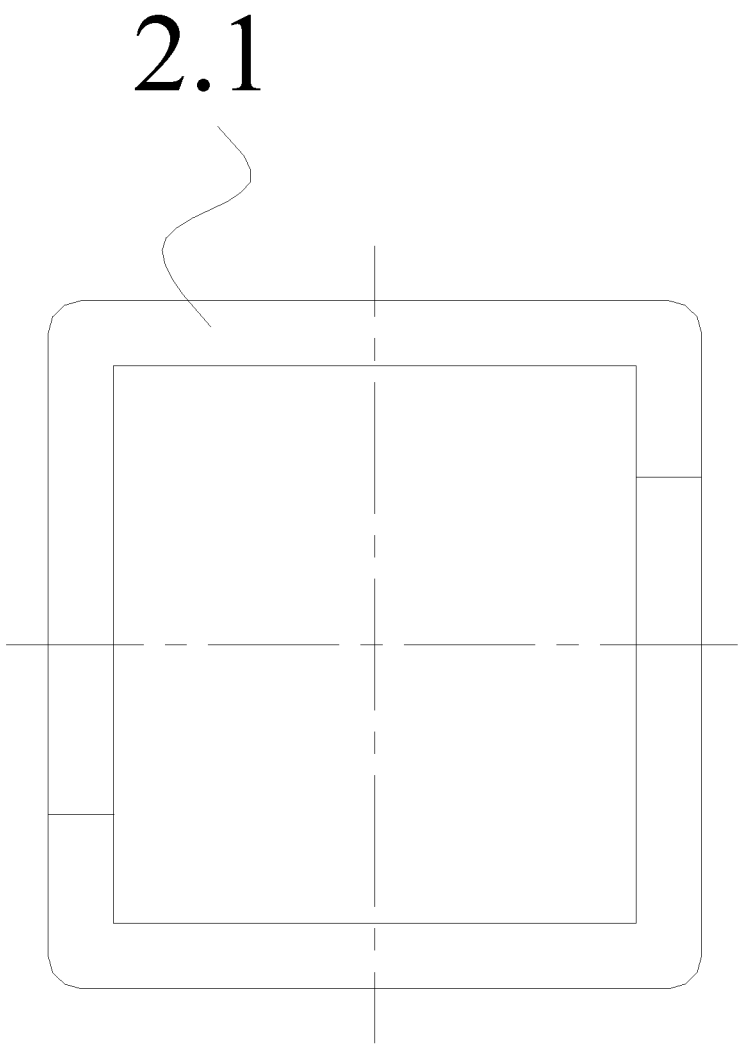
FIG. 7 is a front view of a retaining clip having a quadrilateral inner cavity in accordance with one embodiment of the invention.
Figure 8:
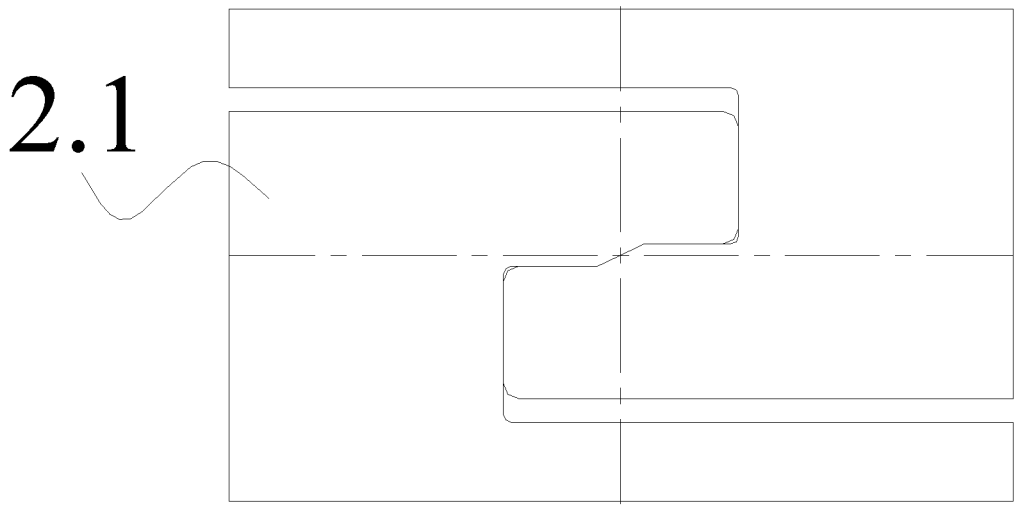
FIG. 8 is a side view of a retaining clip having a quadrilateral inner cavity in accordance with one embodiment of the invention.

As shown in FIGS. 7-8, the retaining clip comprises a quadrilateral through hole for allowing the quadrilateral wire strand to pass through. The retaining clip is formed by locking two independent clamping blocks 2.1 having square openings together, which is convenient to be disassembled, thus being convenient to the shaping and fixation of the wire strand. The retaining clip is also made of nylon material.

5) Coiling the Prefabricated Parallel Wire Preforming Wire Strand

The coiling and the cable relaxing are two opposite operations, the tightness of the coiling directly affects the progress of the cable relaxing and also indirectly affects the forming quality of the wire strand. The prefabricated wire strand is coiled by a coil frame, and a coil diameter is equal to or larger than 30 folds of the diameter of the wire strand.

6) Casting Anchor of the Prefabricated Parallel Wire Pre-Forming Wire Strand

The anchor device is the main structure to transmit a cable tension of the prefabricated parallel wire preformed wire strand to an anchor system. Zinc-copper alloy or zinc-copper-aluminum alloy is adopted for casting, and the casting process is as follows:

a. Ends of the wire strand are perpendicularly fixed in a casting platform of an anchor cup, the steel wires of the wire strand inserted into the anchor cup are dispersed in the form of concentric circles, oil stains and rusts are removed from the steel wires of the wire strand, a uniform space is maintained, and an inner wall of the anchor cup is cleaned.

b. After the wire strand is inserted into the anchor cup, a center of the wire strand coincides with a center of the anchor cup, and the steel wire is prevented from contacting with the anchor cup.

c. A vertical length of the wire strand beneath the anchor cup is equal to or larger than 30 folds of the diameter of the wire strand, and a curved radius is required to be 25 folds larger than the diameter of the wire strand.

d. A lower opening of the anchor cup is required to be fully sealed to ensure no leakage of the poured alloy from the lower opening, and the anchor cup is preheated before casting the zinc-copper alloy or zinc-copper-aluminum alloy.

e. When pouring the alloy into the anchor cup, vibration is prevented, and the casting is carried out fluently without disruption.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method for fabricating a wire strand from parallel steel wires for a main cable of a suspension bridge, the method comprising:

1) selecting and coloring a steel wire as a marking steel wire which is to be positioned at a vertex of the wire strand of the suspension bridge comprising a plurality of parallel steel wires and having an equilateral polygon section;

2) selecting at least one steel wire having a standard length which is to be positioned at one or more vertexes of the wire strand as a standard steel wire to control an overall length of the wire strand of the suspension bridge; adopting a length of the standard steel wire of the wire strand in an unstressed state as a reference, determining position markers at positions of the standard steel wire corresponding to control points of splay cable saddles, center points of main cable saddles, middle points of side spans, a middle point of a middle span, and starting points being one meter away from anchor heads of anchor spans of the suspension bridge; calculating operation corrections corresponding to the position markers of the standard steel wire subject to error factors; loading and stretching the standard steel wire of the wire strand in an unstressed state on a baseline in a construction field; measuring ambient temperature, and correcting errors of the operation corrections resulting from temperature, stress, and sag; calculating and checking position displacement corresponding to the position markers of the standard steel wire; and drawing, according to design requirements, the position markers at positions of the standard steel wire corresponding to control points of splay cable saddles, center points of main cable saddles, middle points of side spans, the middle point of the middle span, and starting points being one meter away from anchor heads of anchor spans of the suspension bridge;

3) loading coils of steel wires having the same double length and the same rotation direction to a pay-out stand; regulating a tension of each coil of the steel wires and shaping a cross section of the steel wires by using a rolling mold comprising shaping wheels and having a hexagonal cross section to yield a prefabricated wire strand comprising a plurality of parallel steel wires; shaping and wrapping the prefabricated wire strand comprising the parallel steel wires at equal intervals by a wrapping bandage; wherein the parallel steel wires comprise feature points corresponding to control points of splay cable saddles, center points of main cable saddles, middle points of side spans, the middle point of the middle span, and starting points of anchor heads of anchor spans of the suspension bridge, and steel wire hoops and shaping clips are disposed on the features points of the parallel steel wires;

4) designing dimension and cross section of the prefabricated wire strand according to dimensions of inner cavities of the main cable saddles and the splay cable saddles; shaping positions of the prefabricated wire strand corresponding to the main cable saddles and the splay cable saddles by a shaping machine to present a target cross section shape corresponding to the shapes of the inner cavities of the main cable saddles and the splay cable saddles, and then respectively fixing the positions of the wire strand corresponding to the main cable saddles and the splay cable saddles using retaining clips repeatedly; wrapping fixed positions of the strain by wrapping bandages, thus achieving preforming of the positions of the wire strand corresponding to the main cable saddles and the splay cable saddles to ensure the shape of the cross section of the wire strand to match the shapes of the inner cavities of the main cable saddles and the splay cable saddles thus mounting the wire strand in the saddles;

5) coiling the wire strand comprising the parallel steel wires by a coil frame, wherein a coil diameter is equal to or larger than 30 folds diameter of the wire strand; and 6) casting anchor of the wire strand comprising parallel steel wires using a zinc-copper alloy or zinc-copper-aluminum alloy and an anchor device which is a main structure to transmit a cable tension of the wire strand comprising the parallel steel wires to an anchor system.

2. The method of claim 1, wherein the length of the standard steel wire of 2) is determined by baseline measurement; in operation, a tensioning force is applied to two ends of the standard steel wire to straighten the steel wire, and stress correction and temperature correction are then carried out according to the following equation:

$$L=L_0\times[(1+F/EA)+\alpha(T-20)]$$

in which, L represents a length of the steel wire in a stressed state, $L_0$ represents a designed length of the steel wire in an unstressed state, F represents a tensioning force, E represents an elastic module of the steel wire, and fabrication of the standard wire adopts a measured value, A represents an area of a cross section of the steel wire, and fabrication of the standard wire adopts the measured value, $\alpha$ represents an expansion coefficient of the steel wire, and T represents a temperature of the environment.

3. The method of claim 1, wherein the steel wire hoops in 3) are formed by wrapping zinc-coated steel wires; and the steel wire hoops have a length of between 100 and 300 mm and a diameter of between 1.0 and 3.0 mm.

4. The method of claim 1, wherein the wrapping bandage comprises a composite substrate comprising a polyester and fiber bands, and a surface of the matrix is coated with a pressure-sensitive adhesive.

5. The method of claim 1, wherein in 4), the cross section of the prefabricated wire strand is shaped from a hexagon into a quadrilateral to facilitate the match of preformed positions of the wire strand with the inner cavities of the main cable saddles and the splay cable saddles.

6. The method of claim 5, wherein the shaping machine of 4) comprises: a U-shaped base and a cover plate disposed above an opening of the U-shaped base; and the U-shaped base and the cover plate form a quadrilateral through hole matching with the quadrilateral cross section of the wire strand.

7. The method of claim 6, wherein curved ribs are formed on two opposite inner sides of the U-shaped base; an extending direction of the curved ribs is parallel to the steel wires of the wire strand; and a radius of each curved rib and an interval between adjacent curved ribs both match with a radius of the steel wire of the wire strand.

8. The method of claim 5, wherein the retaining clip of 4) comprises a quadrilateral through hole for allowing the wire strand to pass through; and the retaining clip comprises two independent clamping blocks having square openings together.

9. The method of claim 1, wherein a casting process of 6) is as follows:

a) perpendicularly fixing ends of the wire strand in a casting platform of an anchor cup, inserting the steel wires of the wire strand in the anchor cup are dispersed in the form of concentric circles, removing oil stains and rusts from the steel wires of the wire strand, and cleaning an inner wall of the anchor cup is cleaned;

b) after the wire strand is inserted into the anchor cup, coinciding a center of the wire strand with a center of the anchor cup, and preventing the steel wire from contacting with the anchor cup;

c) controlling a vertical length of the wire strand beneath the anchor cup to be equal to or larger than 30 folds of the diameter of the wire strand, and a curved radius to be 25 folds larger than the diameter of the wire strand;

d) fully sealing a lower opening of the anchor cup to ensure no leakage of the poured alloy from the lower opening, preheating the anchor cup, and casting the zinc-copper alloy or zinc-copper-aluminum alloy; and e) one-step pouring the alloy into the anchor cup steadily and continuously.

* * * * *